United States Patent [19]

Mochida et al.

[11] Patent Number: 4,486,806

[45] Date of Patent: Dec. 4, 1984

[54] ELECTRONIC DOOR LOCKING SYSTEM FOR AN AUTOMOTIVE VEHICLE

[75] Inventors: Haruo Mochida, Yokohama; Hirotoshi Namazue, Tokyo, both of Japan

[73] Assignees: Nissan Motor Company, Limted; Kokusan Kinzoku Kogyo Co., Ltd., both of Japan

[21] Appl. No.: 373,287

[22] Filed: Apr. 29, 1982

[30] Foreign Application Priority Data

Apr. 30, 1981 [JP] Japan ..... 56-66011

[51] Int. Cl.[3] ..... H01H 47/22

[52] U.S. Cl. ..... 361/172; 307/10 AT; 180/286

[58] Field of Search ..... 361/171, 172; 70/267, 70/271; 307/10 AT, 10 R; 340/825.31, 825.32; 180/286, 289

[56] References Cited

U.S. PATENT DOCUMENTS

| | | | |
|---|---|---|---|
| 3,228,490 | 1/1966 | Ackman | 180/286 |
| 3,587,051 | 6/1971 | Hovey . | |
| 3,593,816 | 7/1971 | Kazaoka . | |
| 3,633,167 | 1/1972 | Hedin . | |
| 3,691,396 | 9/1972 | Hinrichs . | |
| 3,710,316 | 1/1973 | Kromer . | |
| 3,751,718 | 8/1973 | Honchett, Jr. . | |
| 3,754,213 | 8/1973 | Morroni et al. . | |
| 3,764,859 | 10/1973 | Wood . | |
| 3,812,403 | 5/1974 | Gartner . | |
| 3,831,065 | 8/1974 | Martin . | |
| 3,871,474 | 3/1975 | Tomlinson et al. . | |
| 3,878,511 | 4/1975 | Wagner . | |
| 3,885,408 | 5/1975 | Clark, Jr. . | |
| 3,893,073 | 7/1975 | Angello . | |
| 4,189,712 | 2/1980 | Lemelson . | |
| 4,197,524 | 4/1980 | Salem . | |
| 4,205,325 | 5/1980 | Haygood et al. | 340/147 |
| 4,206,491 | 6/1980 | Ligman et al. . | |
| 4,222,088 | 9/1980 | Burton . | |
| 4,249,245 | 2/1981 | Nakanashi . | |

FOREIGN PATENT DOCUMENTS

| | | |
|---|---|---|
| 2913955 | 10/1980 | Fed. Rep. of Germany . |
| 54-103199 | 8/1979 | Japan . |

*Primary Examiner*—Reinhard J. Eisenzopf

*Attorney, Agent, or Firm*—Lowe, King, Price & Becker

[57] ABSTRACT

A door locking system for an automotive vehicle including an anti-theft automatic door locking apparatus by which the door can automatically be locked a fixed time period after the door has been closed in the case where an ignition switch is open and the ignition switch is left at the steering-lock position. The door locking system according to the present invention comprises an ignition switch for detecting the state in which the engine is not operating, a door-close switch for detecting the state where the vehicle doors are closed, a timer for delaying the automatic locking of the doors for a fixed time period, and an AND gate, in addition to the conventional door locking system.

15 Claims, 3 Drawing Figures

ELECTRONIC DOOR LOCKING SYSTEM FOR AN AUTOMOTIVE VEHICLE

BACKGROUND OF THE INVENTION

1. Field of the Invention

The present invention relates generally to an electronic door locking system for an automotive vehicle, and more specifically to an anti-theft automatic door-locking apparatus used with an electronic vehicle-door locking/unlocking system.

2. Description of the Prior Art

The background of the present invention will be explained with respect to its application to the system used with an automotive vehicle.

As is well-known, there exists an electronic push-button type door locking system for an automotive vehicle, by which vehicle doors can be locked or unlocked when the driver depresses a plurality of push-button type switches installed at an appropriate position on the outside of an automotive vehicle in accordance with a predetermined code. When such an electronic vehicle door locking system as described above is used to lock or unlock the doors, since the vehicle doors can be locked or unlocked by the driver without the ignition key, it is very convenient for the driver, in particular, when the vehicle is left parked.

In the above-mentioned electronic door locking system, however, since the vehicle doors can be locked from the outside of the vehicle without use of the ignition key, when the driver parks his vehicle, there exists a problem in that he might leave his vehicle without locking the doors by using the electronic push-button type door locking system and, what is worse, with the ignition key left inserted in the ignition keyhole.

In the case where the vehicle is left parked in the driver's own private parking space with the ignition key left in the ignition keyhole, there may be little chance of the vehicle's being stolen; however, in the case where the vehicle is left parked in public out of the driver's sight with the ignition key left in the ignition keyhole, since a thief can readily see whether or not the ignition key is left inserted in the ignition keyhole, there may be a chance that the thief can easily steal the vehicle by using the ignition key left in the keyhole.

SUMMARY OF THE INVENTION

With these problems in mind, therefore, it is the primary object of the present invention to provide an electronic vehicle-door locking/unlocking system provided with an automatic door locking apparatus, that is, an anti-theft safety device by which the unlocked doors can automatically be locked a predetermined time period after all the vehicle doors have been closed when the ignition switch is open, that is, then the engine is not being operated.

Therefore, in the electronic door locking system according to the present invention, even if the driver forgets to depress the push-button switches in accordance with the predetermined code, the vehicle doors can automatically be locked, thus preventing the vehicle from being stolen.

To achieve the above-mentioned object, the electronic door locking system for an automotive vehicle according to the present invention comprises, in particular, an ignition switch operative when the engine is not operating, a door-close switch operative when all the vehicle doors are closed, a timer unit for delaying the automatic locking of the doors until a predetermined time after all the doors have been closed, and an AND gate, in addition to the conventional electronic door locking system including a code switch, an address counter, a memory unit, a comparator, a door lock/unlock actuating solenoid, etc. Further, in the case where a key-unlock switch, operative when the doors have been unlocked with the ignition key, is additionally provided, the vehicle doors are automatically locked only when the doors have already been unlocked via the push-button switches.

BRIEF DESCRIPTION OF THE DRAWINGS

The features and advantages of the electronic door locking system for an automotive vehicle according to the present invention will be more clearly appreciated from the following description of the preferred embodiment of the invention taken in conjunction with the accompanying drawings in which like reference numerals designate the same or similar elements or sections throughout the figures thereof and in which.

DETAILED DESCRIPTION OF THE PREFERRED EMBODIMENTS

Figure 1:
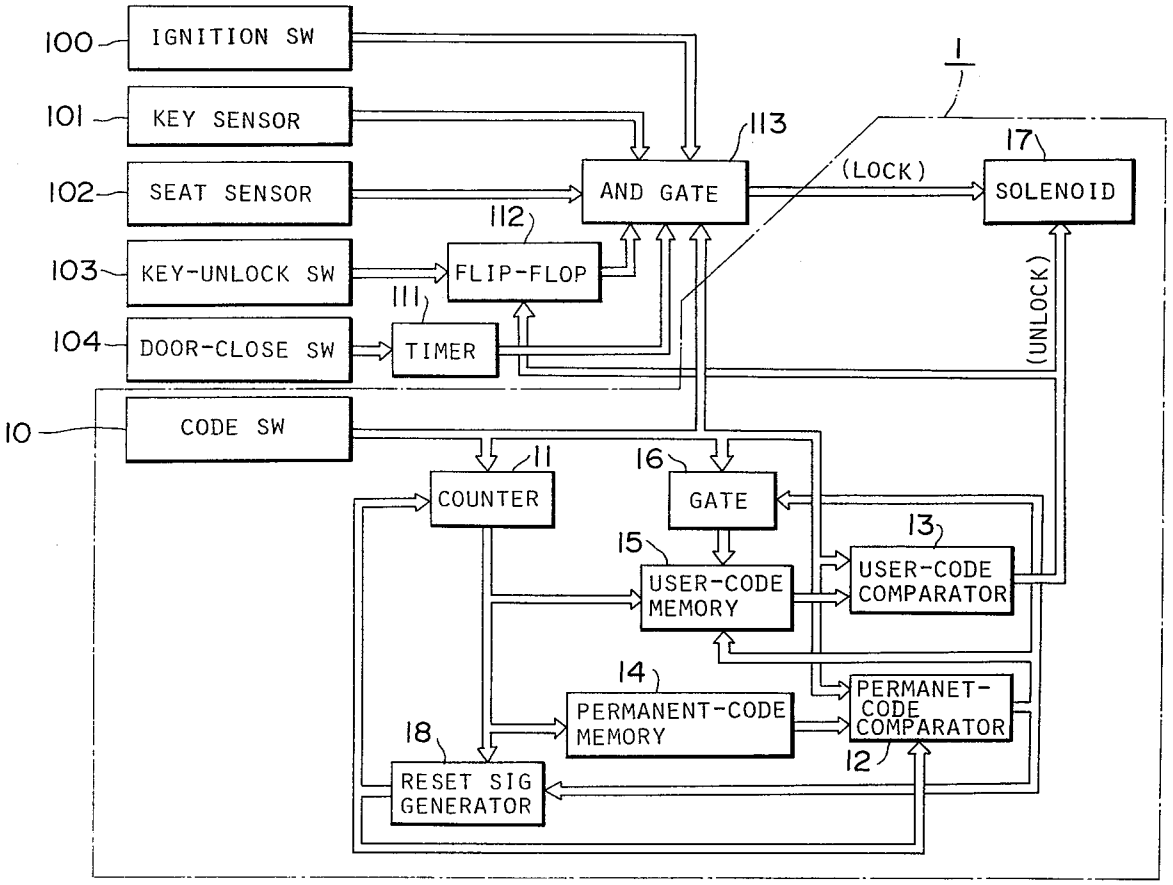
FIG. 1 is a schematic block diagram of an embodiment of the electronic door locking system according to the present invention.

First, an electronic door locking system for an automotive vehicle for which the anti-theft automatic door-locking apparatus according to the present invention is provided will be described by way of example, with reference to FIGS. 1 and 2, in which a permanent-code and a user-selected code are both used in order to improve the anti-theft effect of the locking system.

The example electronic door locking system roughly comprises a code switch 10 made up of a plurality of well-known push-button type switches, an address counter 11, a permanent-code memory unit 14 such as ROM or RAM, a user-code memory unit 15 similar to the permanent-code memory unit, a permanent-code comparator 12, a user-code comparator 13, a gate circuit 16, a reset-signal generator 18, a door locking/unlocking solenoid, etc.

In the above description, permanent code refers, for instance, to a sequence of seven coded digits precoded by the manufacturer or maker; user-code for instance, to a sequence of five coded digits preferably selected by the user or driver.

In order to unlock vehicle doors, the user must first determine a user-preferred digital code and input it into a user-code memory unit 15 via the permanent-code.

When the user depresses the code switch 10 in accordance with a sequence of permanent-code numbers (seven digits in this embodiment), these signals are applied to the address counter 11 and the permanent-code comparator 12, consecutively. The counter 11 counts the number of signals outputted from the code switch 10 and outputs an address-designation signal corresponding to the counted number to the permanent-code memory unit 14. In response to the address-designation signals, the permanent-code memory unit 14 outputs a permanent-code signal associated with the current value of counter 11 to the permanent-code comparator 12. Therefore, the permanent-code comparator 12 commpares the respective permanent-code digit entered via the code switch 10 with the respective one outputted from the permanent-code memory unit 14. If these two signals match, the permanent-code comparator 12 outputs a signal indicative of read-command signal to the gate circuit 16 to open it and to the reset-signal generator 18 to reset the address counter 11 and the permanent-code comparator itself.

At this point, the system is ready to store a user-selected code. When the user depresses a sequence of user-code numbers (five digits in this embodiment), these signals are counted by the address counter 11, and stored consecutively in the user-code memory unit 15 in response to each of address-designation signals outputted from the address counter 11 via the gate 16 already kept open by the read-command signal outputted from the permanent-code comparator 12.

When the address counter 11 counts five digits of the user-code number and outputs a signal to the reset signal generator 18, the reset signal generator 18 outputs a reset signal to reset the address counter 11 itself and the permanent-code comparator 12. Since the permanent-code comparator 12 is reset, the gate circuit 16 is closed, so that the user-code memory 15 stops recording user-code numbers. Now, a user-code has been stored in the system.

Here, the user can unlock the vehicle door by using the stored user-code.

When the user depresses the code switch 10 in accordance with a sequence of user-code numbers already stored in the system, these signals are applied to the address counter 11 already reset and the user-code comparator 13. The address counter 11 counts the number of signals and outputs to the user-code memory unit 15 an address-designation signal corresponding to the counted value. In response to the address-designation signal, the user-code memory unit 15 outputs the stored user-code signal associated with the current value of counter 11 to the user-code comparator 13. Therefore, the user-code comparator 13 compares each user code digit entered via the code switch 10 with the corresponding number outputted from the user-code memory unit 15. If these two signals match for all five inputted digits, the user-code comparator 13 outputs a door-unlocking command signal to a solenoid 17 to unlock the door.

Other elements of FIG. 1 will be explained in more detail later. With reference to FIG. 2, a more detailed description of the operation of the example electronic door locking system for an automotive vehicle will be described hereinbelow.

The code switch 10 includes a set 21 of five push-button switches 21*a*–21*e* which outputs five switch-on signals indicative of five numerals 1, 2, 3, 4 and 5, respectively, and a chattering prevention circuit 22. The signals generated when these switches are depressed are applied to an OR gate 23 via the chattering prevention circuit 22 to detect the number of switch-on signals. The signal from the OR gate 23 is applied to a retriggerable one-shot multivibrator (monostable multivibrator) 27 and a delay circuit 25 which outputs a timing signal. This one-shot multivibrator 27 is provided to reset the whole system via an OR gate 28 by outputting a signal if none of the push-button switches have been depressed for a predetermined period of time (for instance, five seconds).

The output signals from the code switch 10 are applied to the address counter 11 made up of the OR gate 23 and a counter 29. Although the counter 29 has both an UP terminal and a DOWN terminal, the output terminal of the OR gate 23 is connected solely to the UP terminal. This UP/DOWN counter 29 serves as an address counter and outputs address-designation signals to a random-access memory (RAM) 30 (user-code memory 15) and a programmable read-only memory (PROM) 31 (permanent-code memory 14). Therefore, whenever one of the push-button switches 21 is depressed, the address counter 11 is incremented. The output lines from the address counter 11 are connected to the address input terminals of the RAM 30 of the user-code memory unit 15 and the PROM 31 of the permanent-code memory unit 14. The output signals from the RAM 30 and the PROM 31 are applied to a comparator 40 of the user-code comparator 13 and a comparator 41 of the permanent-code comparator 12, respectively. To these comparators 40 and 41, the signals outputted by the push-button switches 21*a*–21*e* are also applied. Therefore, the comparator 40 consecutively compares each user-code digit entered via the push-button switches with the corresponding value stored in the RAM 30 of the user-code memory unit 15, and the comparator 41 consecutively compares each permanent-code digit entered via the push-button switches with the corresponding value stored in the PROM 31 of the permanent-code memory unit 14.

First, the operation of permanent-code entry will be described hereinbelow. When the code switch 10 is depressed, the permanent-code signals are applied to the address counter 29, via the OR gate 23, and to the comparator 41. In response to the address-designation signals from the address counter 29, the PROM 31 outputs the corresponding stored permanent-code signals to the comparator 41.

The output signal from the comparator 41 is applied to the gate input terminal G of a shift register 43 whenever a signal from the push-button switches agrees with the corresponding signal stored in the PROM 31.

In this embodiment, since the signals from the OR-gate 23 are applied to the right-shift terminal RS of the shift register 43 via the delay circuit 25, when one of the switches corresponding to the first permanent-code digit is depressed correctly, a first signal is generated at the output terminal $O_1$. When the switch corresponding to the second permanent-code digit is depressed correctly, a second signal is generated at the first output terminal $O_1$, the first signal being shifted to the second output terminal $O_2$. Similarly, when the user depresses the switches 21*a*–21*e* seven times consecutively with no undue delay and the seven digits entered via the switches agree with the seven digits stored in the PROM 31, signals are generated at all the output terminals $O_1$–$O_7$. Accordingly, an AND gate 44*b* is opened to set the RS flip-flop 46 to output a signal Q. This signal Q resets a shift register 42 and a flip-flop 45 via an OR gate 47; that is, the user-code comparator 13 has been reset.

In this case, it is desirable to light an indicator light 51 indicating that all the entered digits agree with the stored permanent-code digits and therefore it is now possible to store a user-code. For this purpose, the output signal Q of the flip-flop 46 is applied to the indicator light 51 via an inverter 49 to ground one terminal of the light 51.

Further, the shift register 43 functions to generate parallel output signals and to shift the signals right and left; however, it also possible to use an UP/DOWN counter to count up to a predetermined value.

The output signal from the RS flip-flop 46 is also applied to the R/W terminal of the RAM 30 (user-code memory 15) and the gate circuit 39 or 16; as a result, the RAM 30 shifts from a "read" state to a "write" state and the gate circuit 39 (made up of a transistor or thyristor) is opened so as to store the entered user-code into the RAM 30.

On the other hand, since the count in address counter 29 equals seven, the terminal $O_7$ of a counted-value detection circuit 38 (a kind of counter) generates a signal to change one input terminal of the AND gate 37 to a H-voltage level. Further, since the Q output signal from the RS flip-flop 46 is already applied to the other input terminal of the AND gate 37, the AND gate 37 is opened, and the address counter 29 is reset via an OR gate 35, a differentiation circuit 33, and an OR gate 32. In addition, the shift register 42 and the RS flip-flop 45 are both reset by the output signal from the RS flip-flop 46, becoming inoperative. In this state, the permanent code has been properly inputted and the system is waiting for the entry of a new user code to store in user-code memory 15.

Next, the user must enter a user-selected code. When the user depresses some sequence of the push-button switches 21*a*–21*e* to enter five user-code signals, the address counter 29 counts to five, so that an output signal is generated at the terminal $O_5$ of the counted-value detection circuit 38. Since the RS flip-flop 46 is still outputting signal Q, the AND gate 34 is open, so that the signal from the terminal $O_5$ is applied to the reset terminal of the address counter 29 through the OR gate 35, the differentiation circuit 33 and the OR gate 32 to reset it. Since the signal Q from the RS flip-flop 46 is also applied to the AND gate 50, the AND 50 is open, so that the signal from AND gate 34 is applied to the reset terminals of the shift register 43 and the RS flip-flop 46 itself to reset them. Therefore, the signal Q from the RS flip-flop 46 is turned off; the gate circuit 39 is closed; the RAM 30 changes from "write" to "read"; the indicator light 51 goes off. The process of storing of a new user-code has been completed.

The operation to unlock the door will now be described.

When the user depresses the push-button switches 21*a*–21*e* in the correct sequence, these switch signals are fed to the comparator 40. The comparator 40 consecutively compares these switch signals with the user-code stored in the RAM 30 in accordance with the address-designation signals outputted from the address counter 29. If all five digits agree, all the terminals $O_1$–$O_5$ of the shift register 42 change to a H-voltage level, the AND gate 44*a* is opened to set the RS flip-flop 45. Therefore, the RS flip-flop 45 outputs a signal from its terminal Q; a monostable multivibrator 57 is triggered; a door unlocking solenoid 67 is energized through an inverter 62. However, while the vehicle is moving, since a travel sensor 52 outputs a signal to the reset terminals of the shift register 42 and the RS flip-flop 45 via the OR gate 47, the door unlocking operation is disabled. In the state where the RS flip-flop 45 is set, one input terminal of each of NAND gates 61, 63, and 64 changes to a H-voltage level, while the other terminals of these NAND gates receive other input signals such as "all-doors unlocking command signal", "window-opening command signal", or "trunk-lid opening command signal".

When the flip-flop 45 is set, since the terminal $O_5$ of the counted-value detection circuit 38 is also outputting a signal, the AND gate 36 is opened, so that the address counter 29 is reset through the OR gate 35, the differentiation circuit 33 and the OR gate 32.

In this state, when the second push-button switch 21*b* is depressed, a monostable multivibrator 56 is triggered; a NAND gate 61 is opened; a solenoid 66 for unlocking all the doors is energized. When the fourth push-button switch 21*d* is depressed, a monostable multivibrator 58 is triggered; an AND gate 63 is opened; a solenoid 68 for opening all the windows is energized. Similarly, when the fifth switch 21*e* is depressed, the trunk is unlocked. In the state where the RS flip-flop 45 is set, whenever one of the push-button switches 21*a*–21*e* is depressed, since a signal passing through the OR gate 23 resets the address counter 29, it is not possible to enter user-code signals via the push-button switches. When the first push-button switch 21*a* is depressed in the state where the RS flip-flop 45 is set, all the doors are locked, and the output signal from the AND gate 54 resets the address counter 29, the shift register 42 and the RS flip-flop 45 via the OR gate 28.

A power reset device 26 serves to automatically reset the whole system via the OR gates 28, 32, 47, and 48 when a power supply is connected to the system.

Figure 2:
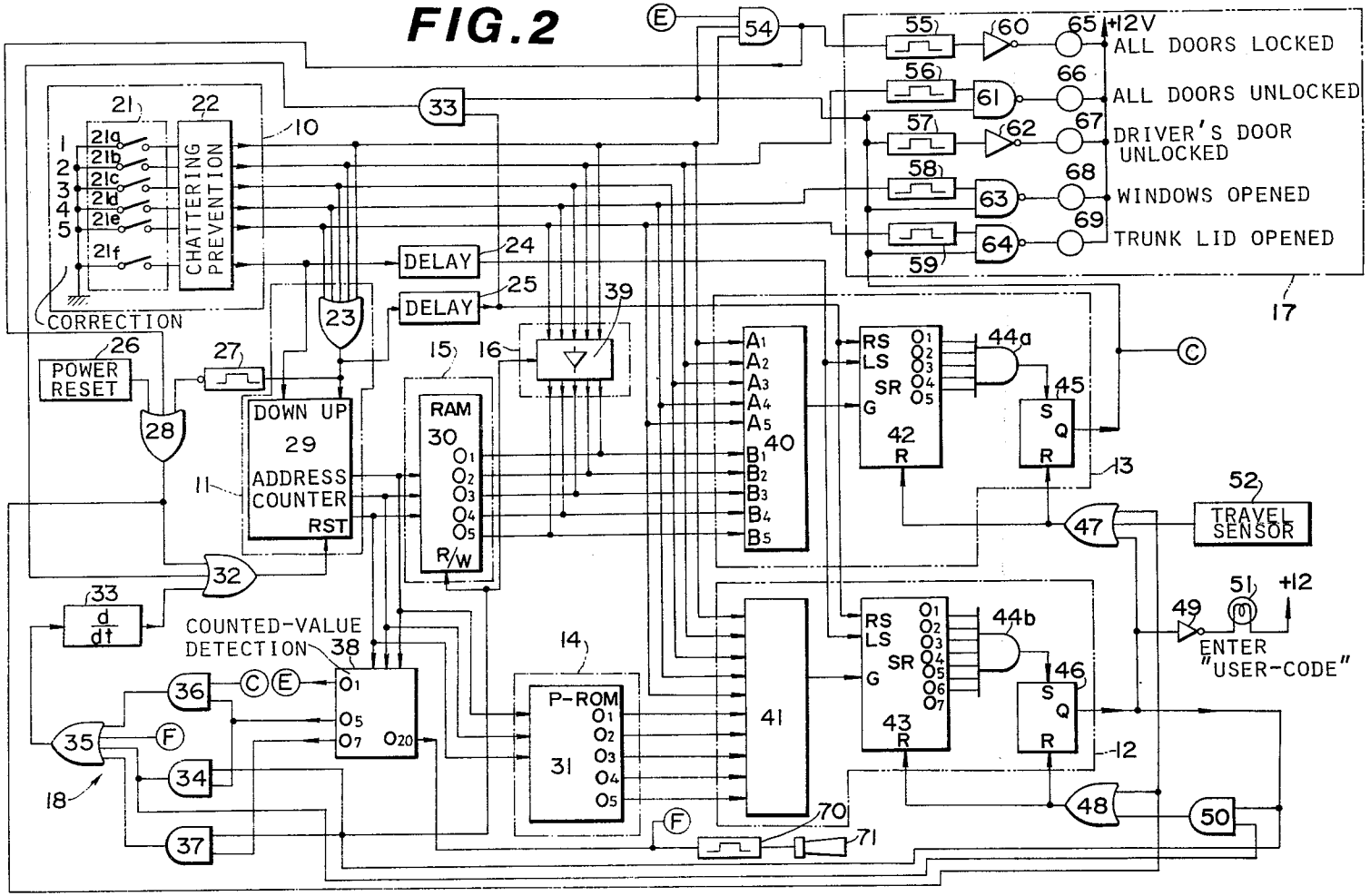
FIG. 2 is a more-detailed schematic block diagram of the electronic door locking system of FIG. 1.

In FIG. 2, a sixth push-button switch 21*f* is provided. When this switch is depressed, a switch-on signal is applied to the left-shift terminals of the shift registers 42 and 43 through the chattering prevention circuit 22 and the delay circuit 24 and simultaneously to the DOWN terminal of the address counter 29. Therefore, by depressing this correction switch 21*f*, it is possible to return the address counter 29 and the shift registers 42 and 43 to the preceding state without having to start again from the beginning.

To prevent erroneous operation by an unauthorized person, the output terminal $O_{20}$ of the calculated-value detection circuit 38 is connected to an alarm device 71 such as a klaxon via a monostable multivibrator 70. Therefore, if the number of switch-on signals not agreeing with the user-code exceeds a predetermined value, the alarm device 70 becomes operative for a fixed time period determined by the monostable multivibrator 70. In this case, the address counter 29 is reset through the OR gate 35 and the differentiation circuit 33.

The system described above can be derived from U.S. Pat. No. 4,205,325, hereby incorporated by reference.

Figure 3:
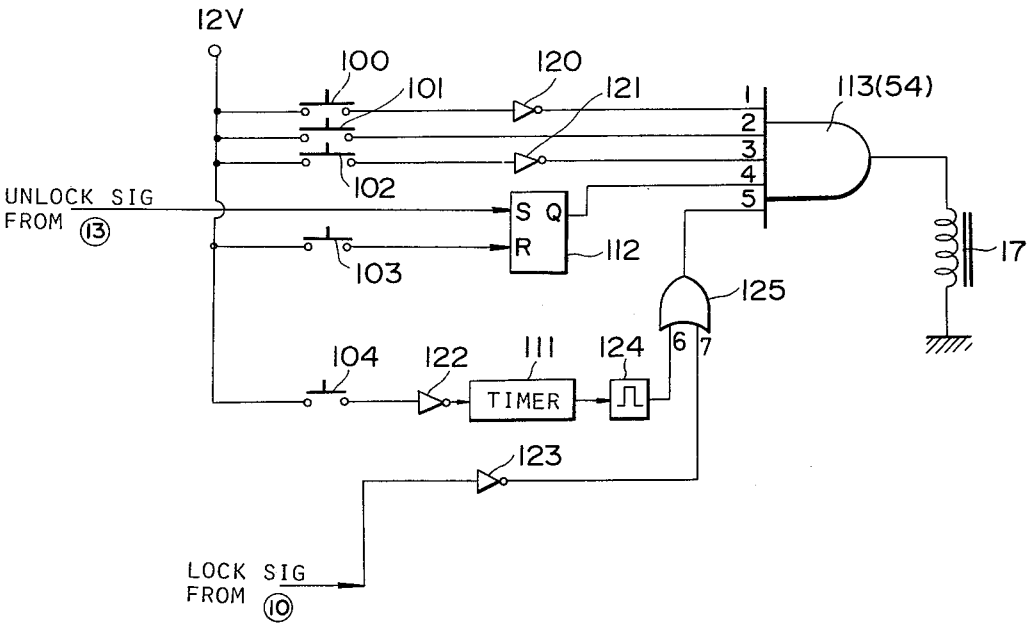
FIG. 3 is a more-detailed schematic block diagram of an embodiment of the anti-theft automatic doorlocking apparatus used with the electronic vehicle-door locking system.

With reference to FIGS. 1 and 3, the anti-theft automatic door locking apparatus according to the present invention provided for the electronic vehicle-door locking/unlocking system explained hereinabove will be described.

In FIG. 1, the reference numeral 100 denotes an ignition switch which is opened to output a L-voltage level signal when the engine is not operating. The reference numeral 101 denotes a steering-lock key sensor which is closed to output a H-voltage level signal when the ignition key is set to the steering-lock position in the ignition key cylinder. The reference numeral 102 denotes a seat switch which is opened to output a L-voltage level signal when there are no passengers sitting in the vehicle seats. The reference numeral 103 denotes a key unlock switch which is closed to output a H-voltage level signal only when the door is unlocked with the ignition key, instead of with the push-button switches. The reference numeral 104 denotes a door-close switch which is opened to output a L-voltage level signal when the doors are closed. The reference numeral 111 denotes a timer unit which is activated when the door-close switch 104 is opened, that is, when the doors are closed. The reference numeral 112 denotes an R-S flip-flop which is set by a door-unlock command signal outputted from the user-code comparator 13 and reset by the H-voltage level signal generated when the key-unlock switch is closed. The reference numeral 113 denotes an AND gate.

With reference to FIG. 3, the conditions under which the solenoid 17 (65 in FIG. 2) is energized to automatically lock all the doors will be described.

(1) when the ignition switch 100 is off, that is, when the ignition key is not set at the ignition position, a L-voltage level signal is applied to the input terminal 1 of the AND gate 113 via an inverter 120, so that the input terminal 1 changes to a H-voltage level.

(2) when the steering-lock key sensor 101 is on, that is, when the ignition key is set at the steering-lock position, a H-voltage level signal is directly applied to the input terminal 2 of the AND gate 113.

(3) when the seat sensor 102 is off, that is, there are no passengers in the vehicle, a L-voltage level signal is applied to the input terminal 3 of the AND gate 113 via an inverter 121, so that the input terminal 3 changes to a H-voltage level.

(4) when the user-code comparator 13 is outputting a door-unlock command signal to the set terminal S of the flip-flop 112 to set it, that is, when the flip-flop 45 is outputting a door-unlock command signal to the set terminal S of the flip-flop 112 (this state means that the user has already unlocked the doors by depressing the push-button switches in accordance with the user code), a H-voltage level signal is applied from the terminal Q of the flip-flop 112 to the input terminal 4 of the AND gate 113.

(5) when the key-unlock switch 103 is open, that is, when the door is not unlocked by using an ignition key, but unlocked by depressing the push-button switches, the reset terminal R of the flip-flop 112 is not reset, so that the input terminal 4 of the AND gate 113 is kept at a H-voltage level. The reason why this key-unlock switch is necessary is as follows:

If, for instance, the vehicle is used by someone other than the owner, the user may not know the unlocking user-code, and therefore he must unlock the door with the ignition key. After he unlocks the door, drives the vehicle, and leaves the vehicle with the ignition key left at the steering-lock position, if the door is automatically locked, since he does not know how to unlock the door with the push-button switches and since the key is within the vehicle, he will not be able to reenter the vehicle. Therefore, when the doors have been unlocked with the ignition key, the automatic door locking operation is disabled.

(6) when the door-close switch 104 is opened, that is, when the door is first opened and then closed after the passenger gets out of the vehicle, a H-voltage level signal obtained via an inverter 122 starts a timer unit 111. After a predetermined time period (several seconds) has elapsed, the timer unit 111 outputs a signal to trigger a one-shot multivibrator 124 and thereby a H-voltage level signal is applied to the input terminal 5 of the AND gate 113 via the input terminal 6 of an OR gate 125.

(7) when a door locking signal is applied to the other input terminal 7 of the OR gate 125 through the code switch 10 (switch 21*a* in FIG. 2), a H-voltage level signal is applied to the input terminal 5 of the AND gate 113 via an inverter 123 and the OR gate 125.

In short, when the ignition switch is off, the key is in the steering-lock position, the door has been unlocked by depressing the code switches, and there are no passengers within the vehicle, if the door is opened and then closed, the door will be automatically locked after several seconds. Under these conditions, the door can also be locked by depressing the door-locking switch 21*a* of the code switch 10.

Furthermore, if the steering-lock key sensor 101 is omitted, even when the driver extracts the ignition key from the keyhole, that is, even when the ignition key is not left within the vehicle, the door can automatically be locked.

In this case, even if the vehicle is parked in public out of the driver's sight, there will be little chance of the vehicle being stolen, because potential thieves will not find the ignition key conveniently in the ignition key cylinder.

As described above, since the doors are automatically locked even if the vehicle is left parked with the ignition key left in the steering-lock position and with the doors left unlocked, it is possible to prevent the vehicle from being stolen, and additionally it is possible to disable automatic door locking by using the key or inside door-locking knobs.

The anti-theft automatic door-locking apparatus according to the present invention has mainly been described when used with an electronic door locking system actuated in accordance with a predetermined user code and a permanent code; however, it is of course possible to apply the present automatic door-locking apparatus to other electronic door locking systems or even a conventional mechanical locking device.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A door locking system for an automotive vehicle for locking vehicle doors, which comprises:

(a) a means for generating a door-locking signal;

(b) an ignition switch for outputting an ignition-off signal when the engine of the vehicle is not operating;

(c) a door-close switch for outputting a door-close signal when all of the vehicle doors are closed;

(d) a timer connected to said door-close switch for outputting a timer signal a predetermined period after the vehicle doors are closed;

(e) an AND gate; input terminals of which are connected to said means for generating a door-locking signal, said ignition switch and said timer for outputting a door locking-command signal when the ignition-off signal is outputted and one of the door-locking signal and the timer signal is outputted thereto; and (f) a door lock actuator connected to said AND gate for locking the vehicle doors in response to the door-locking command signal outputted from said AND gate.

2. An electronic door locking/unlocking system for an automotive vehicle for locking and unlocking vehicle doors, which comprises:

(a) a code switch unit having a plurality of switches for sequentially inputting at least one coded signal;

(b) comparator means for comparing the input coded signals with a predetermined door-locking code sequence and with a predetermined door-unlocking code sequence and outputting a door-locking signal if the input coded signals match the door-locking code sequence and a door-unlocking signal if the input coded signals match the door-unlocking code sequence;

(c) an ignition switch for outputting an ignition-off signal when the engine of the vehicle is not operating;

(d) a door-close switch for outputting a door-close signal when all doors of the vehicle are closed;

(e) a timer unit connected to said door-close switch for outputting a timer signal a predetermined period after the vehicle doors are closed;

(f) an AND gate having a plurality of input terminals connected to said comparator means, said ignition switch and said timer unit for outputting a door locking-command signal when the ignition-off signal is outputted and one of the door-locking signal and the timer unit signal is outputted;

(g) a door lock/unlock actuator connected to said comparator means and said AND gate for locking the vehicle doors in response to the door-locking command signal outputted from said AND gate and unlocking the vehicle doors in response to the door-unlocking signal outputted from said comparator means.

3. An electronic door locking system for an automotive vehicle for locking and unlocking vehicle doors, which comprises:

(a) a code switch unit having a plurality of switches for outputting at least one predetermined door-locking coded switch-on signal and a sequence of predetermined door-unlocking coded switch-on signals;

(b) an address counter connected to said code switch for counting the accumulated number of coded switch-on signals outputted from said code switch whenever one of said switches is depressed and outputting an address-designation signal in response to the number of signals outputted from said code switch;

(c) a memory unit connected to said address counter for storing coded signals in one-to-one correspondence with the values of the address-designation signal and outputting a previously-stored coded signal in response to the address-designation signal outputted from said address counter;

(d) a comparator means connected to said code switch and said memory unit for comparing the signal entered via said code switch with the corresponding coded signal stored in said memory unit and outputting a door unlocking command signal when the coded door-unlocking signal outputted from said code switch agrees with the corresponding coded door-unlocking signals;

(e) an AND gate having a plurality of input terminals and an output terminal, a first input terminal of which is connected to said comparator means;

(f) a door lock/unlock actuating solenoid connected to said comparator means for unlocking the vehicle doors when said comparator means outputs a door unlocking command signal and connected to the output terminal of said AND gate for locking the doors in response to a signal from said AND gate;

(g) an ignition switch connected to a second input terminal of said AND gate for outputting a signal to said AND gate when said ignition switch is open, that is, when an engine of the vehicle is not being ignited;

(h) a timer unit having an input terminal and an output terminal connected to a third one of input terminals of said AND gate for determining a time period from when the vehicle doors are closed by hand to when the doors are automatically locked;

(i) a door close switch connected to the input terminal of said timer unit for outputting a signal to said timer unit to start said timer unit when all the vehicle doors are closed by hand, whereby the vehicle doors are all automatically locked a timer-determined time period after the vehicle doors have been closed when said ignition switch is open.

4. An electronic door locking system for an automotive vehicle for locking and unlocking the vehicle doors as set forth in claim 3, which further comprises:

(a) a first inverter connected between said ignition switch and the second input terminal of said AND gate, for outputting a H-voltage level signal to said AND gate when said ignition switch is open; and (b) a second inverter connected between said door close switch and said timer-unit for outputting a H-voltage level signal to said timer unit when said door close switch is open.

5. An electronic door locking system for an automotive vehicle for locking and unlocking the vehicle doors as set forth in claim 4, which further comprises a third inverter connected between said seat switch and the input terminal of said AND gate connected thereto, for outputting a H-voltage level signal to said AND gate when, in response to presence of no passengers on seats in the vehicle compartment, said seat switch is open.

6. An electronic door locking system for an automotive vehicle for locking and unlocking the vehicle doors as set forth in claim 5, which further comprises key unlock detecting means for disabling the door locking system when a door is opened by a key.

7. An electronic door locking system for an automotive vehicle for locking and unlocking the vehicle doors as set forth in claim 6 wherein said key unlock detecting means comprises reset-set flip-flop means having a reset input terminal connected to a key unlock switch and an output connected to an input of said AND gate, and a set input terminal connected to receive said door unlocking command signal.

8. An electronic door locking system for an automotive vehicle for locking and unlocking vehicle doors as set forth in either of claim 2 or 3, which further comprises an OR gate connected between said timer unit and said AND gate in such a way that one input terminal thereof is connected to the output terminal of said timer unit, the other input terminal thereof is connected to said code switch, and the output terminal thereof is connected to one of the input terminals of said AND gate, whereby the veicle doors are automatically locked a fixed time period after the vehicle doors have been closed or instantaneously locked when a predetermined door-locking switch in said code switch is depressed.

9. An electronic door locking system for an automotive vehicle for locking and unlocking vehicle doors as set forth in any of claim 1, 2 or 3, which further comprises a seat switch connected to an input terminal of said AND gate for outputting a signal to said AND gate when said seat switch is open, that is, when there are no driver or passengers within the vehicle compartment, whereby the vehicle doors are all automatically locked a fixed time period after the vehicle door have been closed when said ignition switch is open and there are no persons within the vehicle compartment.

10. An electronic door locking system for an automotive vehicle for locking and unlocking the vehicle doors as set forth in claim 9 which further comprises a steering-lock key sensor connected to an input terminal of said AND gate for outputting a signal to said AND gate when an ignition key is left at the steering-lock position of an ignition keyhole, whereby the vehicle doors are all automatically locked a fixed time period after the vehicle doors have been closed when the ignition switch is open and the ignition key is set at the steering-lock position or further when there are no persons within the vehicle compartment.

11. An electronic door locking system for an automotive vehicle for locking and unlocking the vehicle doors as set forth in claim 9, which further comprises an inverter connected between said seat switch and the input terminal of said AND gate connected thereto, for outputting a H-voltage level signal to said AND gate when, in response to presence of no passengers on seats in the vehicle compartment, said seat switch is open.

12. An electronic door locking system for an automotive vehicle for locking and unlocking the vehicle doors as set forth in either of claim 2 or 3, which further comprises:

(a) a key-unlock switch for outputting a signal when the door is not unlocked by depressing the push-button switches but unlocked by using an ignition key; and (b) a reset-set flip-flop an output terminal Q of which is connected to an input terminal of said AND gate, a set terminal S of which is connected to said comparator means, and a reset terminal R of which is connected to said key-unlock switch, whereby the vehicle doors are automatically locked when said comparator means outputs a door unlock command signal; that is, when the door is unlocked by depressing the push-button switches, but not automatically locked when the door is unlocked by using the ignition key, even if the ignition switch is open and the ignition key is set at the steering-lock position or further even if there are no persons within the vehicle compartment.

13. A door locking system for an unattended automotive vehicle for locking vehicle doors, which comprises means for locking the doors a predetermined time period after a driver leaves a vehicle and a vehicle door is first opened and then closed with an ignition circuit of the vehicle engine disconnected, including:

(a) a means for generating a door-locking signal;

(b) an ignition switch for outputting an ignition-off signal when the engine of the vehicle is not operating;

(c) a door-close switch for outputting a door-close signal when all of the vehicle doors are closed;

(d) a timer connected to said door-close switch for outputting a timer signal a predetermined period after the vehicle doors are closed;

(e) an AND gate input terminals of which are connected to said means for generating a door-locking signal, said ignition switch and said timer for outputting a door locking-command signal when the ignition-off signal is outputted and one of the door-locking signal and the timer signal is outputted thereto; and (f) a door lock actuator connected to said AND gate for locking the vehicle doors in response to the door-locking command signal outputted from said AND gate.

14. An electronic door locking/unlocking system for an unattended automotive vehicle for locking and unlocking vehicle doors, which comprises means for locking the doors a predetermined time period after a driver leaves a vehicle and a vehicle door is first opened and then closed with an ignition circuit of the vehicle engine disconnected, including:

(a) a code switch unit having a plurality of switches for sequentially inputting at least one coded signal;

(b) comparator means for comparing the input coded signals with a predetermined door-locking code sequence and with a predetermined door-unlocking code sequence and outputting a door-locking signal if the input coded signals match the door-locking code sequence and a door-unlocking signal if the input coded signals match the door-unlocking code sequence;

(c) an ignition switch for outputting an ignition-off signal when the engine of the vehicle is not operating;

(d) a door-close switch for outputting a door-close signal when all doors of the vehicle are closed;

(e) a timer unit connected to said door-close switch for outputting a timer signal a predetermined period after the vehicle doors are closed;

(f) an AND gate having a plurality of input terminals connected to said comparator means, said ignition switch and said timer unit for outputting a door locking-command signal when the ignition-off signal is outputted and one of the door-locking signal and the timer unit signal is outputted;

(g) a door lock/unlock actuator connected to said comparator means and said AND gate for locking the vehicle doors in response to the door-locking command signal outputted from said AND gate and unlocking the vehicle doors in response to the door-unlocking signal outputted from said comparator means.

15. An electronic door locking system for an unattended automotive vehicle for locking and unlocking vehicle doors, which comprises means for locking the doors a predetermined time period after a driver leaves a vehicle and a vehicle door is first opened and then closed with an ignition circuit of the vehicle engine disconnected, including:

(a) a code switch unit having a plurality of switches for outputting at least one predetermined door-locking coded switch-on signal and a sequence of predetermined door-unlocking coded switch-on signals;

(b) an address counter connected to said code switch for counting the accumulated number of coded switch-on signals outputted from said code switch whenever one of said switches is depressed and outputting an address-designation signal in response to the number of signals outputted from said code switch;

(c) a memory unit connected to said address counter for storing coded signals in one-to-one correspondence with the values of the address-designation signal and outputting a previously-stored coded signal in response to the address-designation signal outputted from said address counter;

(d) a comparator means connected to said code switch and said memory unit for comparing the signal entered via said code switch with the corresponding coded signal stored in said memory unit and outputting a door unlocking command signal when the coded door-unlocking signal outputted from said code switch agrees with the corresponding coded door-unlocking signals;

(e) an AND gate having a plurality of input terminals and an output terminal, a first input terminal of which is connected to said comparator means;

(f) a door lock/unlock actuating solenoid connected to said comparator means for unlocking the vehicle doors when said comparator means outputs a door unlocking command signal and connected to the output terminal of said AND gate for locking the doors in response to a signal from said AND gate;

(g) an ignition switch connected to a second input terminal of said AND gate for outputting a signal to said AND gate when said ignition switch is open, that is, when an engine of the vehicle is not being ignited;

(h) a timer unit having an input terminal and an output terminal connected to a third one of input terminals of said AND gate for determining a time period from when the vehicle doors are closed by hand to when the doors are automatically locked;

(i) a door close switch connected to the input terminal of said timer unit for outputting a signal to said timer unit to start said timer unit when all the vehicle doors are closed by hand, whereby the vehicle doors are all automatically locked a timer-determined time period after the vehicle doors have been closed when said ignition switch is open.

* * * * *